United States Patent [19]

Rakowsky et al.

[11] 3,994,226

[45] Nov. 30, 1976

[54] FLUERIC EXPLOSIVE INITIATION DEVICE FOR A FUEL-AIR EXPLOSIVE BOMB

[75] Inventors: Edward L. Rakowsky, Kinnelon; Vincent P. Marchese, Morris Plains; Anthony P. Corrado, Totowa Borough, Passaic County, all of N.J.

[73] Assignee: The United States of America as represented by the Secretary of the Army, Washington, D.C.

[22] Filed: Dec. 18, 1975

[21] Appl. No.: 642,086

[52] U.S. Cl. ..... 102/6; 102/81; 102/90

[51] Int. Cl.[2] ..... F42B 25/16; F42C 5/00

[58] Field of Search ..... 102/81, 70, 49.7, 6, 102/90

[56] References Cited

UNITED STATES PATENTS

| | | | |
|---|---|---|---|
| 3,570,401 | 3/1971 | Euker | 102/6 |
| 3,596,603 | 8/1971 | Gryting et al. | 102/6 X |
| 3,630,150 | 12/1971 | Rakowsky | 102/81 X |
| 3,630,151 | 12/1971 | Rakowsky | 102/81 X |
| 3,672,300 | 6/1972 | Axelson et al. | 102/81 X |
| 3,863,571 | 2/1975 | Campagnoolo et al. | 102/81 |
| 3,938,438 | 2/1976 | Anderson et al. | 102/81 X |

*Primary Examiner*—David H. Brown

*Attorney, Agent, or Firm*—Nathan Edelberg; A. Victor Erkkila

[57] ABSTRACT

A flueric initiator for a fuel-air explosive bomb possesses a sealed housing containing a pressurized gas, a plurality of igniter devices and a means for rupturing the housing and ejecting the igniter devices into the atmosphere. Each igniter device consists of a small gas container, a resonance tube, and explosive charge adjacent to the closed end of the resonance tube, and a nozzle connected to the gas container and communicating with the housing plenum through one or more vents. The housing is initially charged to a pressure considerably higher than the functioning pressure of the nozzle-resonance tube combination.

When the sealed housing is ruptured and the igniter devices are ejected after bomb impact and fuel dispersal, the pressure outside the igniter devices is reduced to ambient pressure, causing the pressurized gas in the gas container to flow out through said nozzle and impinge upon the open end of the resonance tube, thereby reducing the gas pressure until it reaches the level at which resonance tube heating occurs. This rapid heating takes place only after a well-defined, predetermined, settable time delay, detonating the explosive charge and consequently the fuel-air cloud.

7 Claims, No Drawings

FLUERIC EXPLOSIVE INITIATION DEVICE FOR A FUEL-AIR EXPLOSIVE BOMB

GOVERNMENTAL INTEREST

The invention described herein was made in the course of a contract with the Government and may be manufactured, used and licensed by or for the Government for governmenal purposes without the payment to us of any royalty thereon.

BACKGROUND OF THE INVENTION

Fuel-air explosive (FAE) bombs are employed for defeating wheeled vehicles, neutralizing land mines, destroying natural and artificial camouflage to expose battlefield emplacements, etc. FAE munitions utilize foliage-descriminating fuzes which actuate on impact with the target, explosively rupturing thin-walled warheads and dispersing highly volatile liquid fuels into aerosol clouds. The clouds are detonated automatically by delay detonators from center-burster charges that formed the FAE clouds. Generally, the FAE requires a predictable time delay of the order of 100 to 1000 milliseconds.

Methods previously employed to ignite the FAE utilize conventional mechanical or electrical initiation devices. A major disadvantage of such devices is their inability to withstand adequately the high shock loading imposed by the bomb impact (e.g., 100,000 g's) and the high acceleration produced when the initiators are ejected from the bomb. Additional disadvantages include the inability of electrical time fuzes to function accurately to provide delay times approaching one second or longer, as well as the problem of providing a battery storage life of at least 10 years required for military use. Other conventional igniters which rely on percussion contact with the ground or other object are not suitable for such application, since there is no solid object within the aerosol cloud of the FAE.

SUMMARY OF THE INVENTION

An object of the invention is to provide a novel flueric initiator for a fuel-air explosive munition, which eliminates the aforesaid disadvantages, is highly reliable and is characterized by simple, rugged, economic design having no moving parts.

Other objects will become apparent from the following description of the invention.

In accordance with the present invention there is provided a novel flueric initiator for a fuel-air explosive bomb, which comprises a sealed housing containing a gas under pressure, a plurality of novel igniter units or devices and means for rupturing the housing and ejecting the igniter devices into the atmosphere. Each igniter device possesses a gas container, a resonance tube, an explosive igniter charge adjacent to the closed end of the resonance tube, and a nozzle. The nozzle is connected to the gas container and is positioned so as to cause the gas therefrom to impinge on the open end of the resonance tube and flow from the nozzle-resonance tube interaction region through one or more vent passages, which initially permit the gas pressure to equalize in the sealed housing and said gas container.

When the sealed housing is ruptured after bomb impact and fuel dispersal and the igniter devices are ejected into the fuel-air cloud, the pressure outside the igniter devices is reduced to ambient pressure, which causes the gas in the container to flow through said nozzle and vent passage to the atmosphere, thereby reducing the gas pressure until it reaches the level at which resonance tube heating occurs. This rapid heating takes place only after a well-defined, predetermined time delay, e.g. in the range of 100 to 1500 milliseconds or longer, thereby detonating the explosive charge and consequently the FAE cloud. Such time delay is required to allow the fuel to be dispensed and mix with the air to form an explosive cloud. Previous embodiments of the resonance tube heating explosive initiator (see U.S. Pat. Nos. 3,630,150 and 3,630,151) provided only for immediate ignition of the explosive when the gas supply was opened and flow admitted to the nozzle. The novel initiator system of the present invention permits an accurate time delay between the start of the supply gas flow to the nozzle and the initiation of the explosive. This time delay is accomplished by restructuring the size and location of the vent passage and nozzle, changing the size of the interaction chamber, providing a suitable gas supply volume, pressure and gas, modifying the explosive interface material and thickness and utilizing an explosive with compatible ignition temperature characteristics, as more fully discussed below.

DESCRIPTION OF THE PREFERRED EMBODIMENTS

Figure 1:
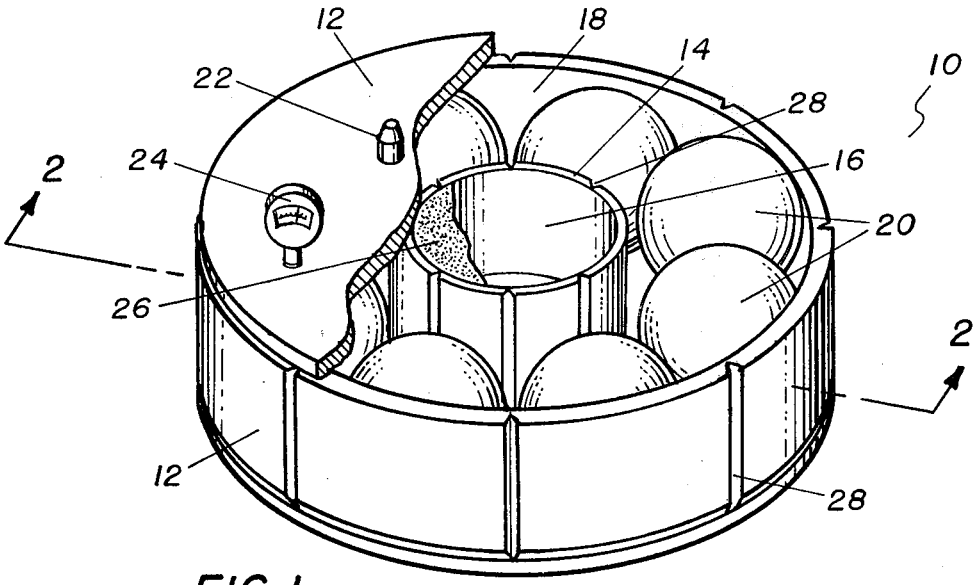
FIG. 1 is a diagrammatic perspective view of a flueric initiator embodying the present invention.
Figure 2:
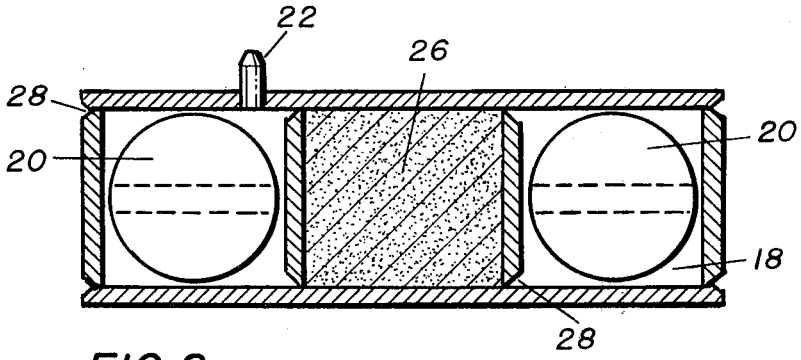
FIG. 2 is a transverse section view taken on line 1—1 of FIG. 1.
Figure 3:
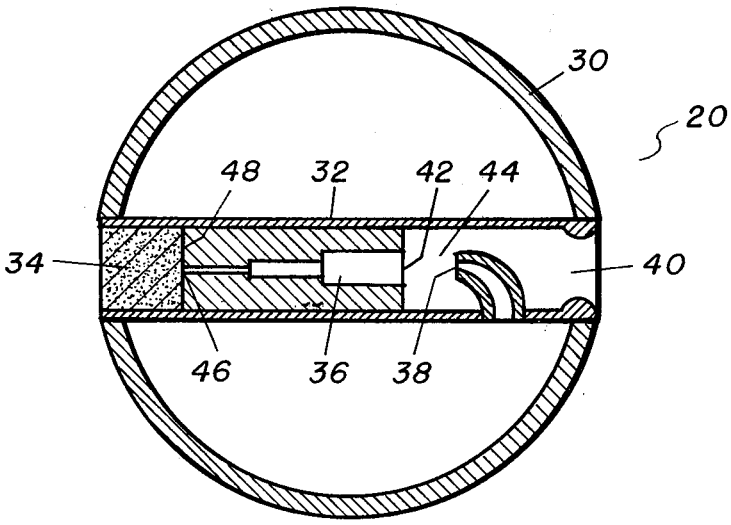
FIG. 3 is a cross-section view of a spherical igniter shown in FIGS. 1 and 2.

As shown in FIGS. 1–3, the flueric initiator 10 comprises a cylindrical housing 12 containing a coaxial cylinder 14, which divides the housing into a central chamber 16 surrounded by an annular chamber 18. The annular chamber 18 contains a plurality of spherical igniter devices 20 and is filled with a gas under pressure. The housing 12 is provided with a fill port and valve 22 for introducing the gas into the annular chamber 18 and a passive indicator 24 to show the state of readiness of the initiator system by indicating that the gas pressure is within the prescribed limits. The pressurized gas within the annular chamber 18 also fills the spherical igniter devices 20 through vent passages described below. the central chamber 16 contains an explosive charge 26, which is suitably initiated upon bomb impact, thereby rupturing the housing and explosively ejecting the spherical igniters 20. The side walls of the housing 12 and coaxial cylinder 14 are provided with notches 28, which cause preferential fracture of the walls so that the spherical igniters 20 are dispersed in essentially a radial direction. The explosive charge 26 can also be preferentially shaped to achieve this dispersion pattern.

As shown in FIG. 3, each igniter device 20 consists of a spherical gas container 30, e.g. of golf ball size, possessing an interiorly mounted alignment tube 32 whose ends communicate with the exterior of the spherical container. The alignment tube contains a coaxially mounted resonance tube 36, an explosive charge 34 positioned adjacent to the closed end 46 of the resonance tube, and a nozzle 38 connected to said gas container. The nozzle 38 is mounted on the alignment tube 32 and is directed toward the open end 42 of the resonance tube, thereby forming an interaction region or chamber 44 between the nozzle and resonance tube as well as providing a vent passage via the alignment tube open end 40, which allows the gas to flow from the nozzle-tube interaction chamber 44 to the exterior and vice versa. Advantageously, the explosive charge 34 is separated from the resonance tube closed end 46 by a thermally conductive interface member 48, e.g. a thin stainless steel disc 0.001 inch thick, which provides a relatively large contact area with the explosive charge 34 and thereby overcomes the tendency of some explosive charges, which shrink or melt on heating, to provide erratic contact with the resonance tube and unreliable ignition of the charge.

When the annular chamber 18 containing the spherical igniter device 20 is filled with a desired gas to the desired pressure, the spherical gas containers 30 are automatically filled with the gas to the same pressure via the nozzle 38 and aforementioned vent passage.

In operation, when the spherical igniter devices 20 are ejected from the housing after bomb impact and fuel dispersal, the pressure outside the igniter devices is reduced essentially to atmospheric pressure, i.e. approximately 14.7 psi., and the gas flow out of the gas containers 30 begins. The pressurized gas in each gas container flows out through the aforesaid nozzle 38 and vent passage and impinges on the open end 42 of the resonance tube 36, thus reducing the gas pressure until it reaches the level at which rapid resonance tube heating occurs. Such rapid heating takes place only after a well defined time interval, thereby detonating the explosive charge and consequently the fuel-air cloud.

The spherical igniter design with internal tube assembly illustrated in FIGS. 1–3 is preferred primarily because of economy of manufacture. Further, the arrangement for storing and ejecting the spherical igniters can be implemented in various other ways, e.g. by use of spring ejector means and variation in housing configuration. However, other igniter designs, e.g. cylindrical, can be used in the present invention, as illustrated in FIGS. 4–6 described below.

Figure 4:
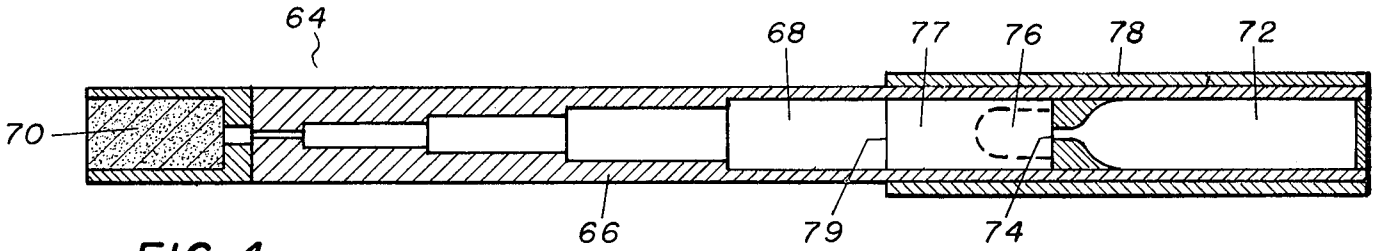
FIG. 4 is a longitudinal cross-section view of an igniter used in a flueric initiator of the present invention.
Figure 6:
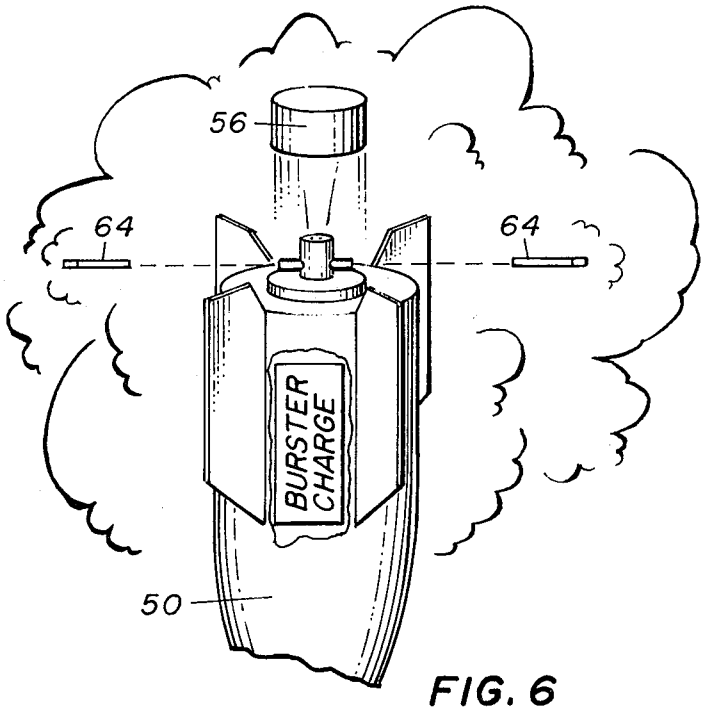
FIG. 6 is a partial schematic view of an FAE bomb, including an enlarged area showing a flueric initiator shown in FIG. 5.
Figure 5:
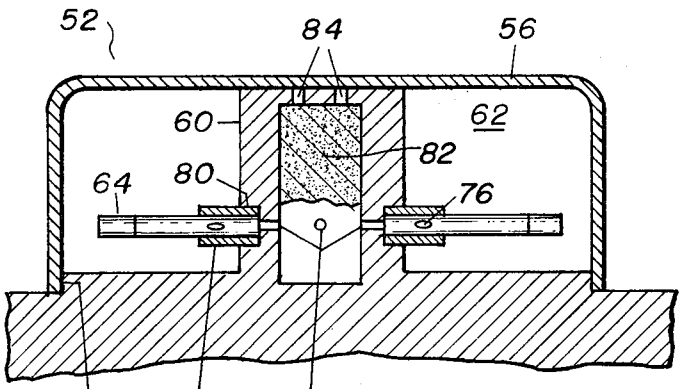
FIG. 5 is a cross-section view of a flueric initiator containing an igniter shown in FIG. 4.

Referring to FIGS. 4–6, a fin-stabilized drop bomb 50 loaded with FAE explosive and provided with a conventional burster charge for dispersing the fuel into the atmosphere to produce an explosive fuel-air mixture, contains a flueric initiator 52 fixed to the bomb rear end 54. The initiator comprises a cylindrical cover 56 affixed to flange 58 on the bomb rear end 54, which has a rearwardly extending integral coaxial hollow post 60. The cover 56 is also joined to the top of the post 60, thereby forming a sealed annular chamber 62 between the post and the cover. Mounted on the post 60 are a number of igniter devices 64 consisting of an alignment tube 66 containing a stepped resonance tube 68, an explosive charge 70 and a gas bottle 72 having a nozzle 74. The alignment tube 66 has a side opening 76, which provides a vent passage from the interaction chamber 77 formed between nozzle 74 and the resonance tube 68. Each igniter device 64 is removably held in a sleeve 78, which is fixedly mounted in a bore 80 in the post 60. The hollow post 60 contains an explosive charge 82 and holes 84, which communicate with the cover 56 and igniter devices 64.

The annular chamber 62 is filled with a gas to the desired pressure, whereby the igniter gas bottles 72 are automatically filled with the gas to the same pressure through the aforementioned vent passage.

On the impact and fuel dispersal, charge 82 is initiated, causing the resulting explosive pressure through holes 84 to eject the cover 56 and igniter devices 64 into the FAE at atmospheric pressure, as shown in FIG. 6. Since the pressure inside the gas bottle 72 is much higher than atmospheric pressure, the gas will flow out through the nozzle 74-side opening 76 vent passage and impinge on the open end 79 of the resonance tube 68, which under preselected conditions will provide a desired time delay for producing a resonant condition and high temperature sufficient to ignite the explosive charge 70 and FAE, as noted above.

The novel igniter system of the present invention allows an accurate time delay between the start of the gas flow through the nozzle and the initiation of the explosive charge. The novel igniter utilizes the unique properties of a modified flueric explosive initiator, which does not operate when supplied with gas pressures above its set point, i.e. operating range of gas pressures causing the resonance tube to resonate and produce heating. Thus, ignition can be delayed simply by sizing the volume and pressure of the gas supply and ratio of nozzle area to vent area. Of course, the ignition temperature characteristics of the type of explosive charge employed, type and thickness of the explosive interface material, design of the resonance tube are also to be considered. For example, the igniter resonance tube can be designed to operate only over a range of gas supply pressures of 125–175 psi. The operation of the igniter can be delayed simply by gas supply overpressure. The overpressure caused delay can be obtained by filling the gas supply bottle 30 with gas, e.g. to 1000 psi., and allowing the gas to discharge through the nozzle 38 until the pressure has dropped to the operating range. Only then does the flueric igniter begin to operate (resonate) and produce heating.

To design an igniter which operates only over a particular pressure range, e.g. 125 to 175 psig., it is necessary to consider the flow properties in the gas interaction region between the nozzle and the resonance tube. This region, called the chamber, comprises the inlet nozzle and one or more outlet vents (cf. chamber 44, FIG. 3). The vent area controls the gas pressure in the interaction chamber, $P_c$, by restricting the outflow, which in turn affects the properties of the jet emanating from the nozzle. The primary effects of small vent areas (less than 10 times the nozzle area) is to expand the operating range and to nullify the effect of operation at high altitudes. The operating range increases because as the nozzle pressure is increased the chamber pressure also increases. This tends to keep the pressure ratio across the nozzle relatively constant, producing a jet pattern insensitive to nozzle overpressures. Reductions of ambient pressures tend to cause a choked flow condition at the vents, thereby maintaining the chamber pressure and the nozzle pressure ratio.

Figure 7:
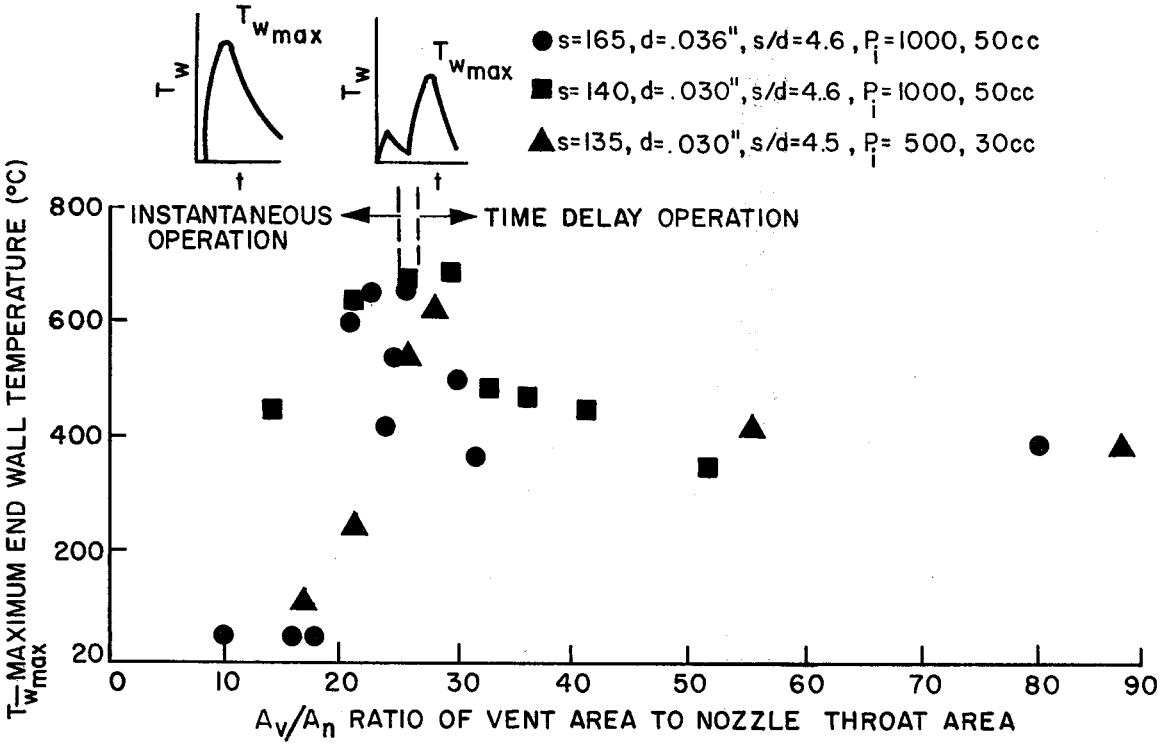
FIGS. 7–9 set forth graphic representations of igniter operating conditions for producing time delay by overpressurization of gas supply.
Figure 8:
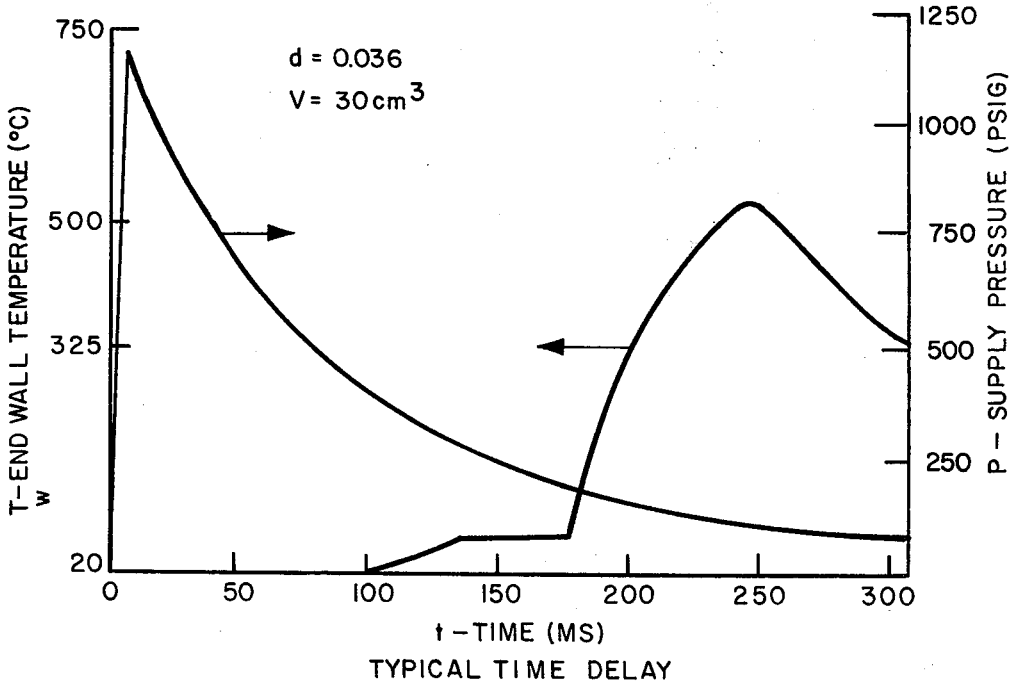

At vent area to nozzle area ratios of about 25 to 1 or larger this self compensation for gas supply overpressures or low ambient pressures no longer exists, thereby allowing a time delay to be obtained by gas supply overpressurization. An example of each type of operation is shown in FIG. 7, wherein s indicates the separation distance in mils between the nozzle and resonance tube, d indicate the nozzle diameter, $P_i$ denotes the initial bottle gas pressure in psig., and 50 cc. and 30 cc. indicate the gas bottle volumes. Although maximum temperatures in the self compensating design are about 1200° C., the maximum temperatures are reduced to 600° C.–800° C. when the vent area is enlarged to allow operation at low supply pressures. The test data shown in FIG. 7 show that the vent area had to be at least about 25 times larger then the nozzle area to insure time delay operation. The data also indicated that if the vent area was too large, i.e. the ratio of vent area to nozzle area $A_v/A_n$ was greater than about 30, then the maximum temperature obtainable was somewhat reduced. With vent area to nozzle area ratios greater than 25 and using a 30 cc. bottle charged to 2000 psi, helium, there is no significant output from the igniter for about 175 milliseconds, after which the output increases very rapidly to 600° C., as shown in FIG. 8.

Longer time delays can be obtained by increasing the gas supply volume, because a longer is required to bleed down to the operating range of the resonance tube, whereby delays as long as 5 seconds can be obtained even with gas supply volumes of only 200 cc.

Figure 9:
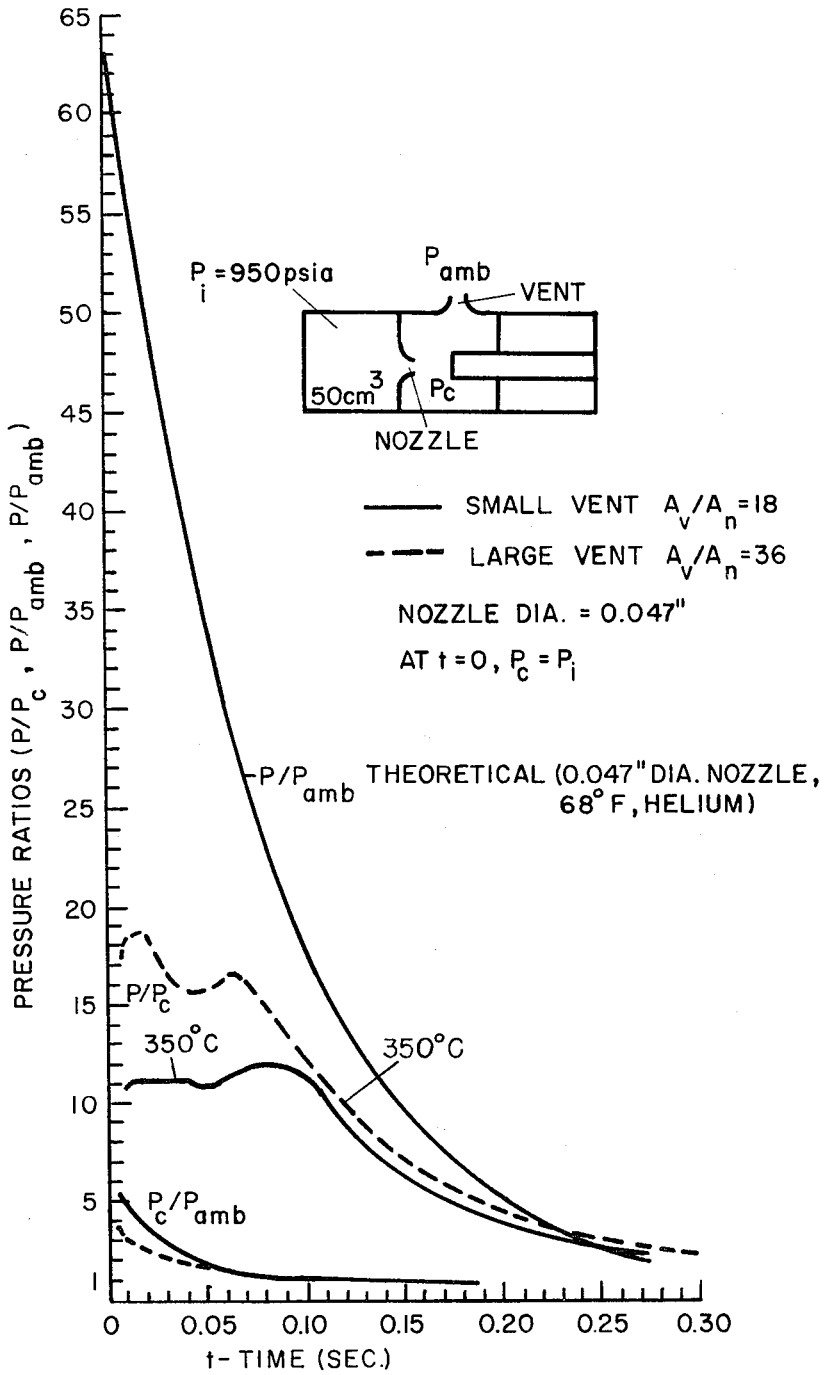

To determine if the vents are large enough for proper operation, it is necessary to measure the pressure ratio across the nozzle. Using a gas supply bottle of 50 $cm^3$ volume filled with 950 psi. helium and a 0.047 in. diameter nozzle, the temperature/time data indicated that the vent area was not large enough to produce a time delay with a particular igniter. This is shown in FIG. 9, which plots the pressure ratio across the nozzle $P/P_c$, as a function of time. Thus, the pressure ratio for the small vent configuration (solid line) remains almost constant at between 11 and 12 due to the high initial chamber pressure $P_c$, which causes the temperature to rise immediately and reach 350° C. within 10 milliseconds. For the same configuration with a vent area twice as large ($A_v/A_n = 36$ vs. 18) the chamber pressure is reduced. This yields pressure ratios $P/P_c$ (dashed line) as high as 19, which delays heating to 350° C. for 140 milliseconds. (As can be seen the pressure drops off faster than the theory would predict because of leakage paths.)

Test were conducted to prove that by the use of the overpressurization principle the novel igniter could ignite KDNBF (potassium dinitrobenzfuroxan) reliably and with a repeatable time delay. This was accomplished by modifying the standard flueric explosive initiator, having a stepped resonance tube about 0.85 in. long and with a 0.062 in. diameter opening, as follows:

| | Standard | Modified |
|---|---|---|
| Gas supply pressure | 250 psig. | 925 psig. |
| Gas supply volume | 1000 $cm^3$ | 30 $cm^3$ |
| Nozzle diameter | 0.047 in. | 0.036 in. |
| Vent area | 0.022 $in.^2$ | 0.035 $in.^2$ |
| $A_v/A_n$ | 12.7 | 34 |
| Time to initiation | 10 ms. | 145 ms. |

These tabulated results are the average of 14 tests wherein all time delays were in very close agreement. The calculated average time delay for these tests was 144.6 milliseconds with a standard deviation of 7.21 milliseconds, showing that a desired repeatability goal of 150 ± 10 milliseconds for the time delay was attainable.

It is thus evident that the novel flueric initiators of the present invention provide a significant technical advance in the art in that they require no moving parts or electrical energy, possess indefinite storage life and are impervious to shock, vibration, radiation and all other hostile enviroments. Further, by means of the novel flueric initiators it is possible to achieve accurate, reproducible initiation time delays by simple adjustment of the design and/or operating parameters. Such time delays ranging from 100 to 1000 milliseconds or longer are accomplished solely through well-defined fluid flow and heat flow principles and are therefore simple to obtain, change and adjust without major modification of the basic hardware. By contrast, electrical and mechanical time delays in this range are very complex and relatively unreliable.

The foregoing disclosure is merely illustrative of the principles of this invention and is not to be interpreted in a limiting sense. We wish it to be understood that we do not desire to be limited to exact details of construction shown and described, because obvious modifications will occur to a person skilled in the art.

We claim:

1. A flueric initiator for a fuel-air explosive munition, which comprises in combination:
   - a sealed housing filled with pressurized gas;
   - a plurality of igniter devices disposed in said housing; and
   - means to rupture said housing and to eject said igniter devices; wherein each of said igniter devices comprises:
   - a gas container;
   - a resonance tube having an open end and a closed end;
   - an explosive charge adjacent to the closed end of said resonance tube;
   - a nozzle connected to said gas container and positioned to impinge the gas flow from said container upon the open end of said tube; and
   - a vent passage for gas flow from the nozzle-resonance tube interaction region and initially for equalization of gas pressure within said gas container and sealed housing; so that when the sealed housing is ruptured and the igniter devices are ejected after bomb impact and fuel dispersal, the pressure outside said gas containers is reduced to ambient pressure, causing the pressurized gas in each gas container to flow out through said nozzle and vent passage and thereby reduce the gas pressure until it reaches the level at which resonance tube heating occurs to detonate said explosive charge, whereby the igniter device is adapted to provide a predetermined delay time between the start of gas flow from said nozzle and the detonation of said explosive charge.

2. The flueric initiator of claim 1, wherein the closed end of the resonance tube is separated from the explosive igniter charge by a thermally conductive interface member providing a relatively wide contact area with said explosive charge.

3. The flueric initiator of claim 1, wherein the ratio of the vent area to the nozzle area is a minimum of about 25 to 1.

4. The flueric initiator of claim 1, wherein the gas container is spherically shaped and the resonance tube, explosive charge and nozzle are coaxially mounted in an alignment tube which is interiorly mounted in said container such that both ends of said alignment tube communicate with the exterior of said container.

5. The flueric initiator of claim 4, wherein the housing is of cylindrical configuration and the igniter devices are annularly disposed within said housing around a coaxial cylindrical chamber containing the means for rupturing said housing and ejecting said igniter devices, the sidewalls of said housing and coaxial chamber being notched to cause preferential rupture of said walls so that the igniter devices are ejected essentially in a radial direction.

6. A fuel-air explosive munition comprising:

a fuel;

means for dispersing said fuel into the atmosphere to produce an explosive fuel-air mixture; and a flueric initiator according to claim 1 for igniting said explosive fuel-air mixture within a predetermined time delay after dispensing of said fuel into the atmosphere.

7. A flueric igniter device comprising:

a gas container;

a resonance tube having an open end and a closed end;

an explosive charge adjacent to the closed end of said resonance tube;

a nozzle connected to said gas container and positioned to impinge the gas flow from said container upon the open end of said tube; and a vent passage for gas flow from the nozzle-resonance tube interaction region;

wherein the gas container is spherically shaped and the resonance tube, explosive charge and nozzle are coaxially mounted in an alignment tube, which is interiorly mounted in said container such that both ends of said alignment tube communicate with exterior of said container;

so that when pressurized gas from said container flows through said nozzle and vent passage to the atmosphere, the gas pressure therein is reduced until it reaches a level at which resonance tube heating occurs to detonate said explosive charge, whereby the igniter is adapted to provide a predetermined time delay between the start of gas flow from said nozzle and the detonation of said explosive charge.

* * * * *